United States Patent [19]

Bushaw

[11] Patent Number: 4,648,709

[45] Date of Patent: Mar. 10, 1987

[54] METHOD AND APPARATUS FOR PRODUCING TRANSPARENT FOIL COPIES

[75] Inventor: Kenneth A. Bushaw, Longmont, Colo.

[73] Assignee: International Business Machines Corporation, Armonk, N.Y.

[21] Appl. No.: 809,629

[22] Filed: Dec. 16, 1985

[51] Int. Cl.[4] ..... G03G 15/00

[52] U.S. Cl. ..... 355/77; 355/14 SH; 355/64; 355/3 R

[58] Field of Search ..... 355/3 SH, 14 SH, 77, 355/72, 64, 3 R, 100; 271/9, 10, 120, 233

[56] References Cited

U.S. PATENT DOCUMENTS

| | | | |
|---|---|---|---|
| 4,072,420 | 2/1978 | Wicks et al. | 355/100 |
| 4,089,516 | 5/1978 | Colglazier et al. | 271/9 |
| 4,113,245 | 9/1978 | Colglazier et al. | 271/10 |
| 4,126,305 | 11/1978 | Colglazier et al. | 271/120 |
| 4,279,504 | 7/1981 | Brown et al. | 355/72 |
| 4,285,512 | 8/1981 | Shlatz | 271/233 |
| 4,436,404 | 3/1984 | Simmons et al. | 355/3 SH |
| 4,469,322 | 9/1984 | Kogure et al. | 355/3 SH X |
| 4,528,056 | 7/1985 | Hunt et al. | 355/3 SH X |
| 4,531,823 | 7/1985 | Deguchi et al. | 355/3 R |
| 4,534,643 | 8/1985 | Watanabe | 355/3 SH |
| 4,609,282 | 9/1986 | Crandall | 355/3 SH |

*Primary Examiner*—A. C. Prescott

*Attorney, Agent, or Firm*—Francis A. Sirr

[57] ABSTRACT

An automatic method and copier apparatus for producing a transparent foil copy and a paper backup sheet of an original document sheet is disclosed. Two modes of operation are described. One mode produces one foil copy and a paper backup copy. A second mode produces one foil copy and a blank backup sheet. A copier is disclosed having two paper supply bins. Blank foils are loaded into one bin, whereas blank paper is loaded into the other bin. In the first mode of operation, two consecutive copies are made of each original document. One copy is made on blank foil taken from said one bin, followed by a second copy made on a blank sheet of copy paper taken from said other bin. In the second mode of operation, one copy is made on blank foil, followed by feeding a sheet of blank paper without making a copy thereon. In each mode of operation, the result is a two sheet set comprising a first foil sheet and a second paper sheet. When a multisheet original document is copied, the document is copied using a document feeder, copying continues until all original sheets have been copied, and the foil/paper sets of each original sheet are stacked in an output means in collated sequence. A number of cathode ray tube display screens assists the operator in controlling the copier to produce these modes of operation. Alternatively, buttons are used to assist the operator in so controlling the copier.

35 Claims, 7 Drawing Figures

FIG. 2

READY TO MAKE
COPIES

PRESS PRGM FOR OTHER
FUNCTIONS

FIG. 3

FUNCTION SELECTION MENU

1 NEXT JOB SETUP
2 SPECIAL JOB SETUPS
3 UNCOLLATED COPY
4 DOCUMENT COVERS
5 KEY OPERATOR FUNCTIONS
6 READ USER METER
7 FOILS

ENTER FUNCTION NUMBER
OR
PUSH PRGM TO END

FIG. 4

FOILS SELECTED

1 COPIED BACKUP SHEET
2 BLANK BACKUP SHEET

ENTER FUNCTION NUMBER
OR
PUSH PRGM TO END

FIG. 5

FOILS SELECTED

- PLACE BLANK FOILS IN UPPER PAPER DRAWER
- PLACE COPY PAPER IN LOWER PAPER DRAWER
- COPY COUNT WILL BE 2

PRESS PRGM TO
LEAVE THIS SCREEN

FIG. 6

READY TO MAKE COPIES

FOILS SELECTED

PUSH CLR TO CANCEL

METHOD AND APPARATUS FOR PRODUCING TRANSPARENT FOIL COPIES

DESCRIPTION

1. Field of the Invention

This invention relates to the field of copying of original document using an electrophotographic reproduction device, and to the production of transparent foil copies of the original document, which foils are later used in conjunction with projection equipment.

2. Background of the Invention

The dissemination of the information image which is contained on an original paper document has taken many forms. One of the most useful forms is the production of plain paper copies of the original document. In this way, a single original document can be inexpensively and conveniently converted into many copies, for widespread distribution. When the information is be conveyed to an audience in both an audio and a visual manner, the use of transparent foil copies and overhead projectors has come into widespread use. Many modern copiers are capable of forming a toner image onto both paper sheets and transparent foil sheets. However, the operation is manual, and is not convenient.

One example of such a copier is found in U.S. Pat. No. 4,279,504. In this patent, a paper cassette holds a supply of blank paper. The cassette is constructed and arranged so that a single sheet can be manually placed on top of the cassette. This sheet will now be fed rather than the underlying sheets in the cassette. This mode of operation is called a single sheet bypass procedure. This patent teaches that when the operator wants to produce a foil copy of an original sheet, followed by a paper copy of this same original sheet, a blank transparent foil is manually placed in this sheet bypass area. The copier is manually set to make two copies, and the copy process is activated. As a result, the first copy is made on the sheet bypass foil, and the second backup copy is made on blank paper. The production of additional foil/paper pairs requires the operator to repeat this manual process once for each original document sheet.

This construction is representative of the way in which a two copy set, i.e., a foil/paper pair, of an original document was been produced in the prior art. Such an arrangement is time consuming and not at all convenient for the operator, in that the operator must continually attend the copier, manually loading sheets, and foils and original documents, as needed. This construction also does not allow the operator to produce a blank backup paper sheet when one is desired.

SUMMARY OF THE INVENTION

The present invention provides a method and apparatus whereby foil/paper pairs of each original document sheet are produced in an automatic manner. In accordance with the present invention, the operator merely indicates that the production of foils is requested of the copier. Upon receiving such a request, the operator is instructed to load a stack of transparent foils in a specific one of the copier's two paper supply bins. The other supply bin contains a stack of plain paper, as is conventional. The operator may then select the production of a paper backup copy, or a blank sheet of paper as a backup sheet.

When a paper backup copy is selected, the copier is automatically set to make two copies of each original document sheet. As original document sheets are subsequently presented for copying, two copies of each sheet are made, and the copier's paper feed mechanism automatically feeds a first copy sheet out of the foil bin, followed by a second copy sheet out of the paper bin.

When a blank paper backup sheet is selected, the copier is automatically set to make one copy of each original document sheet. As original document sheets are subsequently presented for copying, one copy of each sheet is made, as the copier's paper feed mechanism automatically feeds a copy sheet out of the foil bin. This is followed by feeding a second sheet out of the paper bin, without making a copy of the original document sheet thereon.

When an automatic document feeder is used to feed a multi-sheet original document in page collated sequence, the selected one of the above processes is automatically repeated until all sheets of the original document have been fed. The foil/paper sheet output of the copier is fed in a manner (i.e., inverted if necessary) to produce a page collated copy of the original document.

A cathode ray tube (CRT) display is provided to aid the operator in implementing the method of the present invention. These and other features of the present invention will be apparent from the following description of preferred embodiments of the invention.

BRIEF DESCRIPTION OF THE DRAWING

FIGS. 2, 3, 4, 5 and 6 are cathode ray tube display screens which appear on the control panel of the FIG. 1 copier, and direct the operator in accordance with the present invention.

THE INVENTION

Figure 1:
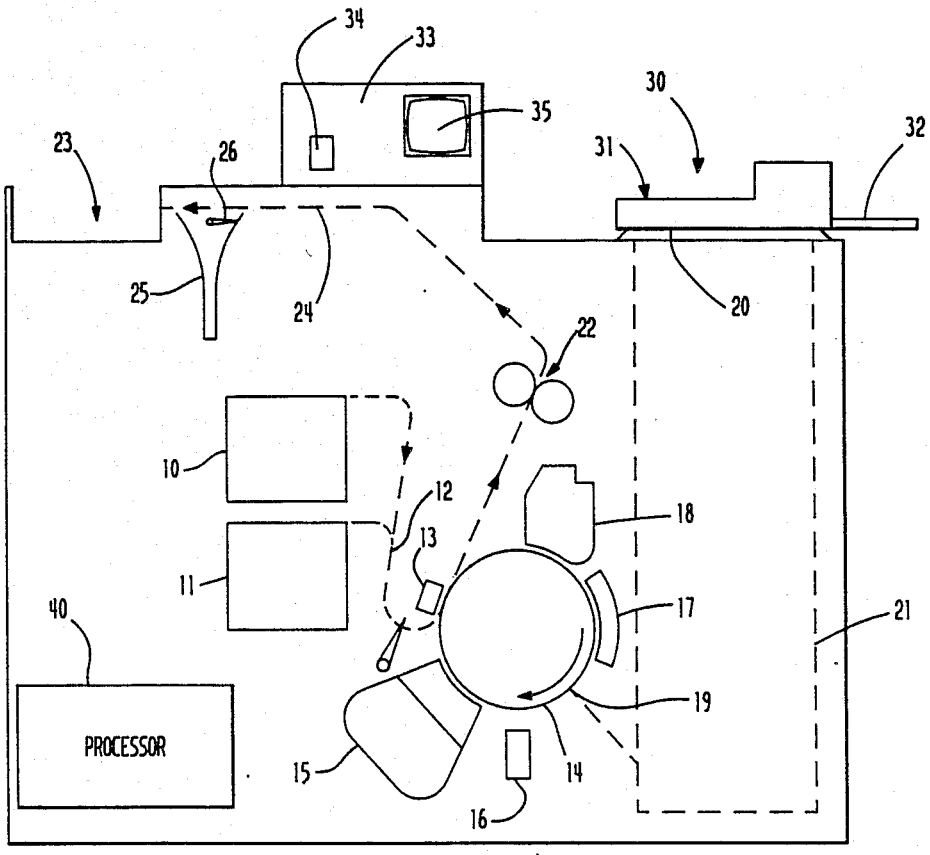
FIG. 1 is a xerographic copier including the present invention.

A copier incorporating the present invention is shown in FIG. 1. This copier is of the type commercially known as the IBM Series III copier/duplicator. While the present invention will be described in association with this copier's construction and arrangement, the present invention is of general utility, and its scope is not to be limited to any specific reproduction device.

Components of this copier include a first and second paper supply bin 10 and 11. Each bin is constructed and arranged to hold a relatively large stack of blank cut sheet copy substrate. These bins are accessible to the operator by way of doors (not shown) that can be opened in order to allow the operator to resupply one or both of the bins with paper, or to change the size or the type of substrate currently in a bin.

In accordance with the present invention, a multi-sheet stack of transparent foils are placed in a bin, more specifically, on top of the paper stack already in bin 10.

The paper feeding mechanism contained in each of bins 10 and 11 feeds the copy substrate therein from the top of the stack, one sheet at a time. These sheets are fed to paper path 12, where the sheets are aligned as they move to the copier's transfer station 13.

When the operator selects production of paper copies, bin 11 is automatically used to produce these copies, unless the operator specifically selects use of alternate bin 10 by depressing a control panel button. Only with the present invention is copy substrate alternately fed first out of bin 10 and then out of bin 11.

The paper feed mechanism in each of bins 10 and 11 may be of the type shown and described in U.S. Pat. Nos. 4,089,516; 4,113,245 and 4,126,305, incorporated herein by reference.

Conventional copier process stations surround photoconductor drum 14. These stations include magnetic brush developer station 15, photoconductor erase station 16, photoconductor charging station 17, photoconductor cleaning station 18, and photoconductor imaging station 19.

An original document sheet which is to be copied is placed on glass platen 20, with the sheet's image facing downward. An optics module 21, whose details are well known in the art, enables the sheet's image to be projected to imaging station 19. In this way, an electrostatic latent image of the document is formed on the photoconductor. This image is toned at developer station 15, and the photoconductor's toner image is transferred to copy substrate at transfer station 13. Thereafter, the substrate is conveyed to hot roll fuser 22, whereat the toner image is fused to the surface of the substrate. The finished copy sheet is now transported to exit tray 23.

As is apparent, while the sheet resides in paper path 24 its image faces upward. If it is desired that the image face downward, the sheet is routed through a conventional sheet inverter 25, known to those of skill in the art. This operation is controlled by the position of sheet deflecting vane 26. Vane 26 operates to intercept and deflect a sheet into the inverter whenever the image is to face downward.

A feature of the present invention is to automatically select use of inverter 25 whenever the foils function is selected by the operator, to thereby insure that a collated stack of copies are produced in exit tray 23.

FIG. 1 shows a simple means of handling the sheet output of the copier in that only an exit tray is provided. However, it is within the scope of this invention to provide other copy handlers. For example, a set finisher of the type which can staple copy sets, and/or provide stacking offset to distinguish one set from another, can be provided. Other copier features such as image reduction, duplex copying, and the like can also be provided.

A feature of the present invention provides automatic selection of exit tray 23 when the production of foils is selected. Selection of the foils function also automatically results in disabling all copier features, such as the use of a set finisher, which are not compatible with the making of foils, whenever the operator selects the foils function. The exact functions to be automatically disabled depend on the type of functions supplied by the copier, thus the present invention is broadly directed to automatically selecting certain functions, and disabling other functions which are incompatible with the production of foils, in whatever copier configuration happens to be in use.

An original document sheet to be copied is automatically placed on platen 20 by automatic document feeder 30, i.e., a recirculating automatic document feeder (RADF), an automatic document feeder (ADF), and/or a semiautomatic document feeder (SADF). Document feeders of this type are well known in the art, and will not be described in detail.

When an automatic document feeder, i.e., either an ADF or an RADF, is used in accordance with the present invention, the operator can indicate to the copier's logic that the document feeder contains duplex original documents. When this is the case, the copier automatically inverts each sheet of the original document, to thereby enable simplex copying of each side of each original document sheet. Thus, when the original document contains N sheets, the simplex foil/paper sets which are produced in accordance with the present invention equal 2-times-N sets, or 4-times-N sheets.

This document feeder may be, for example, of the type shown and described in U.S. Pat. No. 4,285,512, incorporated herein by reference. Document feeder 30 provides both ADF and SADF operation. The feeder includes an ADF tray 31 on which a multi-sheet stack of original documents can be stacked, image side facing upward. When this mode of document feeding is used, the copier operates to make copies so long as at least one original sheet remains on tray 31, and copying automatically ceases when the document feeder detects that tray 31 is empty. The document feeder also includes an an SADF feeder tray 32 into which the operator manually loads original document sheets, one sheet at a time, with the image facing downward. Tray 32 includes a sheet sensor which operates to continue operation of the copier so long as an original document sheet is present at tray 32.

The specific construction of document feeder 30 is not critical to the present invention, since those skilled in the art are aware of many such document feeders.

A feature of the present invention is that production of foil copies automatically continues until detection that no more original document sheets remain to be copied.

The copier of FIG. 1 includes a control panel 33 having manual control buttons for use by the operator in controlling the copier. One set of such buttons is numeric keyboard 34 which is used, for example, by the operator to indicate how many copies of each original document sheet are to be produced. The keyboard contains buttons which are numbered "1" through "9", as well as a button labeled "clr" (meaning clear), and a button labeled "prgm" (meaning program). In the absence of operation of any number keybutton, the copier defaults to making one copy of each original document.

A feature of the present invention is that when the operator selects the production of foils, the copier automatically is placed in a control state so as to feed a foil from bin 10, and to thereafter feed a sheet of paper from bin 11, i.e., two copy substrate sheets are fed for each original document sheet image, one sheet from each bin.

Another feature of the present invention is that when the operator selects a paper backup copy, the copier is automatically placed in a control state to produce two copies of each original document.

Panel 33 also includes a display 35 whereby the copier's logic intelligence communicates with the operator. In accordance with a feature of this invention, this display is one on which messages appear in order to lead an operator through the process of preparing the copier for the production of foils. Preferably, display 35 is a cathode ray tube (CRT) display on which text and/or graphic information appears.

As an alternative to a display such as CRT 35, control panel pushbuttons can be provided which enable the operator to control the copier in accordance with the present invention, and the present invention is to be considered to be of this scope. For example, the production of a foil copy and a blank backup paper sheet could be requested by depressing a button labeled "Foils - Type 1"; whereas, a "Foils - Type 2" button could be provided to produce a foil copy and a backup paper copy.

FIG. 2 shows the CRT screen message which appears on display 35 when the copier is in a standby mode, i.e., the copier is awaiting an operator's initial request. With this display present, the operator can simply depress number buttons 34 in order to request a certain number of copies, and then depress the copier's control panel "start" button. When other functions, such as the foil function of the present invention are desired, the operator depresses the "prgm" button.

The "prgm" button calls up the CRT display screen of FIG. 3. This display instructs the operator to depress certain number keys of keyboard 34 in order to invoke the indicated function. Depressing any button not listed in FIG. 3 generates an audio beep, as a reminder to the operator that an incorrect button has been depressed. Depressing the "prgm" button returns the display to that shown in FIG. 2.

In order to select production of foils, the operator depresses number button "7". In response to this operation, the display changes to that shown in FIG. 4. This new display allows the operator to select a copied backup sheet, or a blank backup sheet. If the operator wishes to de-select the foils function, the "prgm" button is depressed, whereupon the display of FIG. 3 reappears.

After the operator has selected from the menu of FIG. 4, the screen of FIG. 5 appears on display 35. This display requires no selection by the operator, but does prompt the operator to load blank foils into upper paper drawer 10, and to load paper in drawer 11, or at least check the drawer to make sure that the required paper is already in drawer 11. After this is done, the operator depresses the copier's "prgm" button, and the screen of FIG. 6 appears.

The copier is now in a condition to make copies in accordance with the present invention. This operation begins when the operator depresses the control panel's "start" button. However, the foil function is aborted at this screen if the operator depresses the "clr" button.

The present invention also allows the operator to select some additional copier features, which are compatible with the production of foils, before the "start" button is depressed. For example, the operator is allowed to select the production of light or dark copies, and if document feeder 30 is an ADF or an RADF, the presence of two-sided originals in the document feeder may be indicated. When a two-sided original document is indicated, the document feeder is controlled to invert each original document sheet, thereby enabling simplex copying of both sides of an original document sheet.

The copier's logic intelligence comprises a micro processor 40 which, in a manner well known to those skilled in the art, controls all of the various processes of the copier to produce the method of the present invention. One skilled in the art is enabled by the flow chart of FIG. 7 to program processor 40 in order to provide the method of the present invention.

Figure 7:
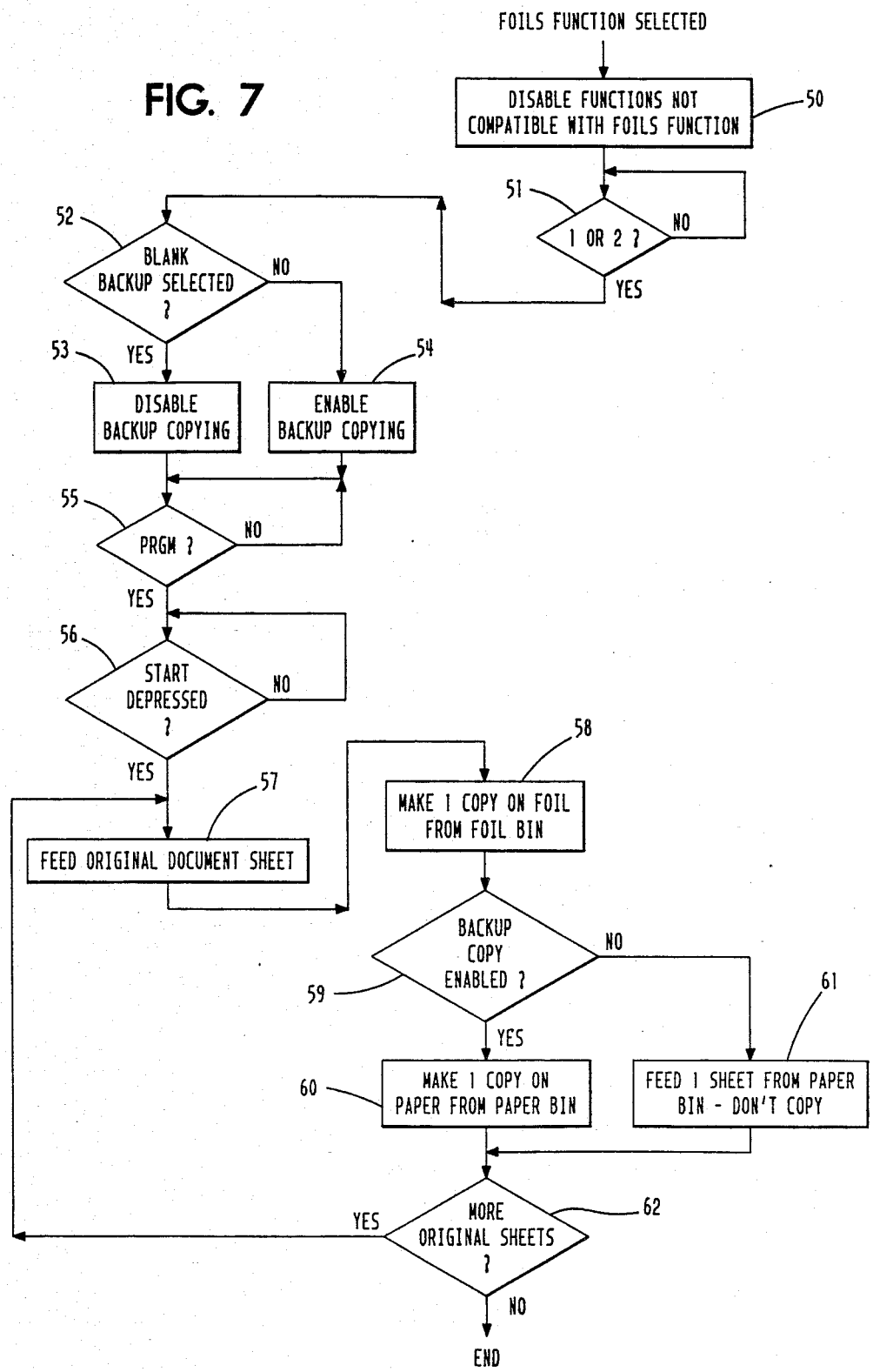
FIG. 7 is a program flow chart enabling those skilled in the art to write a micro processor program, or construct a discrete logic network, to control the FIG. 1 copier in accordance with the present invention.

The flow chart of FIG. 7 begins with the selection of the foils function from the screen of FIG. 3. When this selection is detected, all incompatible copier functions are disabled, see flow chart block 50. Flow chart decision block 51 next inquires as to the selection of a blank or a copied paper backup sheet. This selection was indicated by the operator depressing keybutton number "1" or "2" when the display of FIG. 4 is active on display 35.

If a copied backup sheet is selected, two copies of the original document will be made, and backup copy flow chart block 54 and paper feeding flow chart block 60 are enabled. If a blank backup sheet is selected, one copy will be made, and backup copying is disabled via flow chart block 53, as paper feeding flow chart block 61 is enabled.

The program now waits until the operator indicates that the prompt of the FIG. 5 screen has been complied with; see block 55. When the copier's start button is thereafter depressed, see block 56, an original document is fed from document feeder tray 31, see block 57.

With the document positioned on platen 20, the copier makes one copy on a sheet of foil which is automatically taken from bin 10; see block 58.

As noted above, when a copied backup was selected by the operator, from the screen of FIG. 4, a sheet of paper is automatically fed from bin 11, and a copy is made thereon; see block 60. However, when a blank backup sheet is selected, a copy is not made on this sheet; see block 61.

So long as more original document sheets are present on tray 31, or on tray 32, the foil production mode continues; see block 62.

While this invention has been particularly shown and described with reference to preferred embodiments thereof, it will be understood by those skilled in the art that various changes in form and detail may be made therein without departing from the spirit and scope of this invention.

What is claimed is:

1. A method of using a copier to automatically produce two-sheet simplex copy sets of each sheet of a multi-sheet original document, one sheet of each set being a copy of an original document sheet's image which is produced on a sheet of blank transparent foil, and the other sheet of each set being a backup paper sheet, comprising the steps of:

A—selecting the production of foils, and as a result thereof setting said copier to produce at least one copy of each sheet of said original document, and to feed two copy sheets for each original document sheet;

B—providing a first and a second supply bin for sheets on which copies can be produced;

C—providing at least N number of blank foil sheets in said first supply bin;

D—providing at least N number of blank paper sheets in said second supply bin;

E—feeding an original document containing N sheets, one sheet at a time, to an imaging station for the purpose of copying the image contained thereon;

F—copying said image at least one time on a sheet of blank foil taken from said first supply bin; and G—feeding a backup paper sheet from said second supply bin prior to copying another original document sheet.

2. The method of claim 1 including the step of selecting a backup paper sheet having a copy of the original document thereon, whereupon step A is modified to set said copier to produce two consecutive copies of each original document sheet, and said step G is modified to produce a second copy of said image on said backup paper sheet.

3. The method of claim 1 including the step of selecting a blank paper backup sheet, whereupon said step G is modified to feed a sheet of blank paper from said second supply bin without producing a copy thereon.

4. The method of claim 1 including the step of collecting said two-sheet copy sets in a stack in collated order.

5. The method of claim 2 including the steps of feeding said original document in page collated order, and collecting said two-sheet copy sets in a stack in page collated order.

6. The method of claim 3 including the steps of feeding said original document in page collated order, and collecting each two-sheet set in a stack in page collated order.

7. The method of claim 1 including the step of repeating steps A through G so long as at least one original document sheet remains to be copied.

8. The method of claim 2 including the step of repeating said method so long as at least one original document sheet remains to be copied.

9. The method of claim 3 including the step of said repeating said method so long as at least one original document sheet remains to be copied.

10. The method of claim 1 including the step of providing a recirculating automatic document feeder and feeding a duplex original document containing N sheets, one sheet at a time, to an imaging station for the purpose of producing 2-times-N simplex copies thereof, whereupon said steps C and D are modified to provide at least 2-times-N sheets in said first and second supply bins.

11. The method of claim 2 including the step of providing a recirculating automatic document feeder and feeding a duplex original document containing N sheets, one sheet at a time, to an imaging station for the purpose of producing 2-times-N simplex copies thereof, whereupon said steps C and D are modified to provide at least 2-times-N sheets in said first and second supply bins.

12. The method of claim 2 including the step of providing a document feeder to feed an original document containing N sheets, one sheet at a time, to an imaging station for the purpose of copying the image contained on each of the N sheets thereof.

13. The method of claim 3 including the step of providing a document feeder to feed an original document containing N sheets, one sheet at a time, to an imaging station for the purpose of copying the image contained on each of the N sheets thereof.

14. A method of using a copier to automatically produce a foil copy substrate and a paper backup substrate corresponding to an original document substrate, comprising the steps of:

A—providing a first and a second supply bin for substrate on which copies can be produced;

B—providing a first display whereby an operator may select the production of foil substrate;

C—setting said copier to produce at least one copy of said original document substrate upon said operator selecting the production of foils;

D—providing a second display indicating to said operator the need to place blank foil substrate in said first supply bin;

E—feeding said original document to an imaging station for the purpose of copying; and F—copying said original document at least once on blank foil substrate taken from said first supply bin, and feeding a substrate from said second supply bin prior to making a copy of another original substrate.

15. The method of claim 14 including the step of providing a third display as a result of said operator selecting the production of foils, which third display enables said operator to select between the following two options:

(1) the production of a blank backup substrate, and (2) the production of a copy backup substrate, whereupon when said operator selects option (1), said step C is not modified; and whereupon when said operator selects option (2), said step C is modified to set said copier to produce two consecutive copies of said original document, and said step F is modified to produce a second copy on substrate taken from said second supply bin.

16. The method of claim 15 including the step of providing a fourth display, following said third display, whereby said operator can select copier functions which are compatible with the production of foil substrate.

17. The method of claim 14 wherein said first and second displays are provided on a cathode ray tube.

18. The method of claim 15 wherein said first, second and third displays are provided on a cathode ray tube.

19. The method of claim 16 wherein said first, second, third and fourth displays are provided on a cathode ray tube.

20. The method of claim 14 wherein said copier includes a numeric keyboard, and said cathode ray tube displays instruct said operator to make selections by depressing designated numbers of said keyboard.

21. The method of claim 15 wherein said copier includes a numeric keyboard, and said cathode ray tube displays instruct said operator to make selections by depressing designated numbers of said keyboard.

22. The method of claim 16 wherein said copier includes a numeric keyboard, and said cathode ray tube displays instruct said operator to make selections by depressing designated numbers of said keyboard.

23. The method of claim 20 wherein when said copier is in a standby mode and is ready to make copies, a standby display enables said operator to choose between the production of copies on substrate taken from said first or said second bins, or to select other copier functions whereupon said first display appears on said cathode ray tube.

24. The method of claim 21 wherein when said copier is in a standby mode and is ready to make copies, a standby display enables said operator to choose between the production of copies on substrate taken from said first or said second bins, or to select other copier functions whereupon said first display appears on said cathode ray tube.

25. The method of claim 22 wherein when said copier is in a standby mode and is ready to make copies, a standby display enables said operator to choose between the production of copies on substrate taken from said first or said second bins, or to select other copier functions whereupon said first display appears on said cathode ray tube.

26. The method of claim 1 including the step of disabling copier functions which are not compatible with the production of foils.

27. The method of claim 14 including the step of disabling copier functions which are not compatible with the production of foils when the production of foils is selected by said operator.

28. The method of claim 15 including the step of disabling copier functions which are not compatible with the production of foils when the production of foils is selected by said operator.

29. The method of claim 1 wherein said copier includes a control micro processor, and wherein said method is implemented by program code which controls said copier when the production of foils is selected.

30. The method of claim 2 wherein said copier includes a control micro processor, and wherein said method is implemented by program code which controls said copier when the production of foils is selected.

31. The method of claim 3 wherein said copier includes a control micro processor, and wherein said method is implemented by program code which controls said copier when the production of foils is selected.

32. The method of claim 14 wherein said copier includes a control micro processor, and wherein said method is implemented by program code which controls said copier when the production of foils is selected.

33. The method of claim 15 wherein said copier includes a control micro processor, and wherein said method is implemented by program code which controls said copier when the production of foils is selected.

34. The method of claim 14 including the steps of providing an original document feeder to feed an original document having a number of substrate sheets therein, to hereby produce at least one foil substrate and one backup substrate for each original substrate, collecting the produced substrate in a collated stack, and repeating said method until no more original substrate sheets remain in said document feeder.

35. The method of claim 15 including the steps of providing an original document feeder to feed an original document having a number of substrate sheets therein, to hereby produce at least one foil substrate and one backup substrate for each original substrate, collecting the produced substrate in a collated stack, and repeating said method until no more original substrate sheets remain in said document feeder.

* * * * *